United States Patent [19]

Olsen

[11] Patent Number: 4,752,001

[45] Date of Patent: Jun. 21, 1988

[54] PROOF OF PURCHASE DETACHABLE TAB

[75] Inventor: Robert C. Olsen, Streamwood, Ill.

[73] Assignee: Illinois Tool Works Inc., Chicago, Ill.

[21] Appl. No.: 15,998

[22] Filed: Feb. 18, 1987

[51] Int. Cl.[4] ..... B65D 75/00

[52] U.S. Cl. ..... 206/150; 206/459; 206/831

[58] Field of Search ..... 206/145, 150, 151, 156, 206/158, 161, 432, 459, 831

[56] References Cited

U.S. PATENT DOCUMENTS

| | | | |
|---|---|---|---|
| 3,403,779 | 10/1968 | Becker et al. | 206/432 |
| 3,532,214 | 10/1970 | Helms | 206/432 X |
| 3,653,504 | 4/1972 | Saumsiegle | 206/161 |
| 3,721,337 | 3/1973 | Braun et al. | 206/150 |
| 3,850,361 | 11/1974 | Day et al. | 229/1.5 B |
| 4,064,989 | 12/1977 | Olsen | 206/150 |
| 4,171,085 | 10/1979 | Doty | 229/1.5 B |
| 4,190,149 | 2/1980 | Oliff et al. | 206/145 |
| 4,453,664 | 6/1984 | Oliff | 206/459 |

OTHER PUBLICATIONS

Introducing ITW Hi-Cones', "Cut-N-Save", Strategic Frontiers Inc, 1984 (no month).

*Primary Examiner*—Stephen Marcus

*Attorney, Agent, or Firm*—Thomas W. Buckman

[57] ABSTRACT

A carrier device for unitizing a plurality of containers comprising annular bands defining a plurality of apertures generally arranged in ranks and rows. Annular bands defining adjacent pairs of apertures in a given row being integrally connected by webs and bands defining apertures in a given rank being integrally connected by spaced webs. Spaced webs present margins defining spaces. The tab is connected to a marginal portion of one side of the space by non-detachable means and is frangibly connected to a marginal portion of an opposite side of the space by frangible or detachable means.

4 Claims, 2 Drawing Sheets

PROOF OF PURCHASE DETACHABLE TAB

This invention relates to a carrier device for containers such as cans and the like, and more specifically to a carrier device having a novel frangibly connected detachable tab which can be used as a proof of purchase marketing device.

Carrier devices of the general type disclosed herein are well-known in the art. As shown in prior art U.S. Pat. Nos. 4,064,989; 3,721,337; 2,997,164 and 3,733,100 carrier devices having tabs are also well-known in the art.

However, none of the aformentioned patented devices includes a tab which is well suited for use as a proof of purchase device. For example, in U.S. Pat. Nos. 4,064,989; 3,721,337; and 2,997,164 the tabs disclosed therein were all designed so that they could be pulled by the user to severably release the containers from the carrier devices. Thus, the tabs could easily be removed before the merchandise was purchased.

Accordingly, it is an object of this invention to provide a carrier device for containers such as cans and the like which includes a tab which is frangibly connected to the device.

A further object of the invention is to provide a carrier device which includes a tab which is connected to the device so that the tab lays flat in the same plane as the carrier device.

It is a more specific object of this invention to provide a carrier device with a tab which is connected to the carrier device in such a manner that it cannot be easily removed by the purchaser until the containers are removed from the carrier device.

SUMMARY OF THE INVENTION

The carrier device of the present invention is designed for packaging containers such as cans or bottles and the like. The carrier device is formed from a resilient elastic deformable sheet of plastic. The carrier device comprises a plurality of apertures generally arranged in ranks and rows, defined by an annular band. Adjacent pairs of apertures in a given row are integrally connected by webs and adjacent pairs of apertures in a rank are integrally connected by spaced webs. The spaced webs present margins defining spaces. A tab transverses at least one space. The tab is securely attached to a marginal portion of one side of the space by non-detachable means and is frangibly connected to an opposite side or marginal portion of the space by detachable means. A user can apply pressure to the tab and easily tear the detachable means while the tab remains secured to the marginal portion of one side of the space by the non-detachable means. Subsequently, the user can detach the tab from the carrier device by cutting the detachable means with scissors or the like.

BRIEF DESCRIPTION OF THE DRAWINGS

The above and further objects of the invention will be apparent and fully pointed out in the detailed description and the accompanying drawings in which.

DETAILED DESCRIPTION OF THE ILLUSTRATED EMBODIMENT

Figure 1:
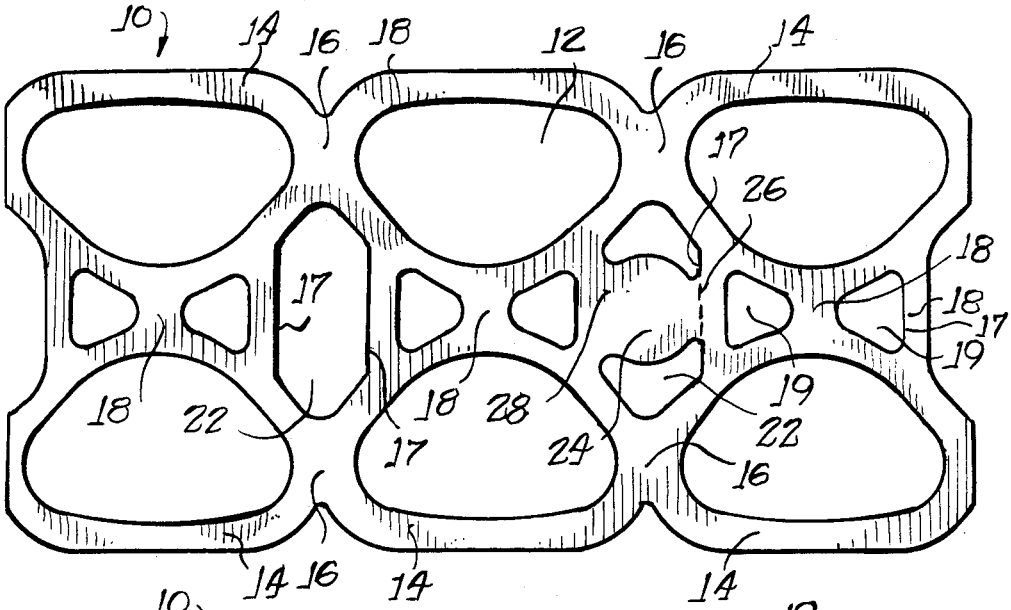
FIG. 1 is a top plan view of the preferred embodiment of the carrier device incorporating features of the present invention.

FIGS. 1 through 4 of the drawings show the preferred embodiment of carrier device 10. Such carrier device 10 is typically made from a resilient sheet of tough elastic plastic material such as polyurathane. The carrier device 10 includes annular bands 14. The bands 14 define a plurality of apertures 12 arranged generally in ranks and rows. Adjacent pairs of apertures 12 and bands 14 in each row are integrally connected by webs 16 and each adjacent pair of apertures 12 and bands 14 in each rank are integrally connected by a plurality of spaced junction lines or webs 18. The webs 18 present margins 17 defining spaces 19 and enlarged spaced means or finger holes 22. The carrier device 10 is typically provided with three lateral ranks of two longitudinal rows of apertures and bands, but can be made with any desired number of ranks and rows. The number of apertures 12 is equal in number to the number of containers to be associated therewith. The carrier device 10 can be used in connection with a variety of types of containers 20 including but not limited to cans, bottles and the like. The apertures 12 are dimensioned so that the bands 14 frictionally and resiliently engage the body (not shown) of the containers 20.

In the preferred embodiment of this invention a tab 24 is connected to opposite sides of at least one finger hole 22. Tab 24 is frangibly connected to a portion of the margin 17 of one side of the finger hole 22 by a detachable means 26. The detachable means 26 is cut, slit or perforated so that it can tear easily. The tab 24 is securely attached to a portion of the margin 17 of the opposite side of the finger hole 22 by hinge means or non-detachable means or junction line 28. The non-detachable means or hinge is not perforated. Generally, plastic of the type used to form carrier device 10, cannot be easily torn without the aid of some type of sharp instrument.

Figure 2:
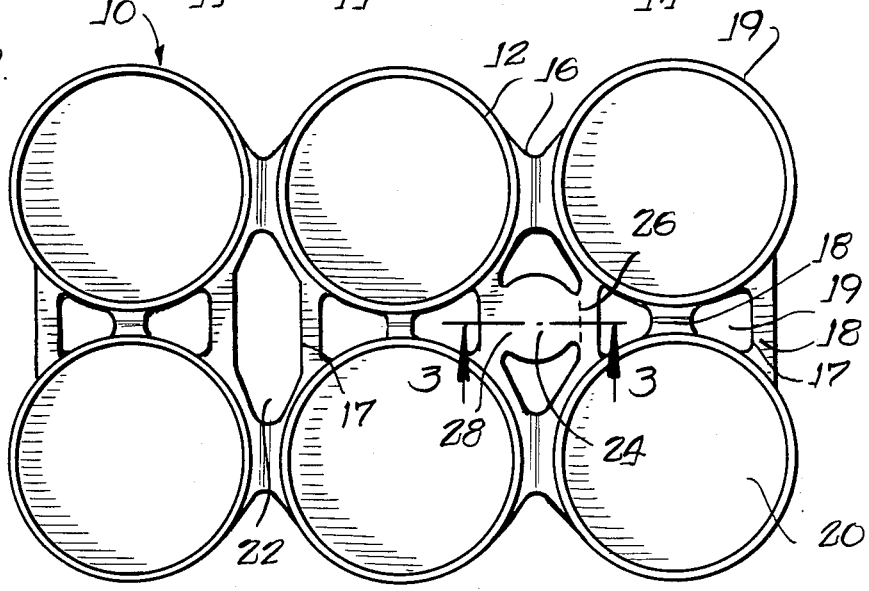
FIG. 2 is a top plan view of the preferred embodiment of the carrier device after it is applied to containers.

As shown in FIG. 2, the location of tab 24 makes it difficult to remove the tab without first removing the containers 20. This is an important feature of this invention because the tab 24 is intended to provide a proof of purchase device. It should be readily apparent that tab 24 can also be used to clearly display the manufacturer's or seller's logo.

Figure 3:
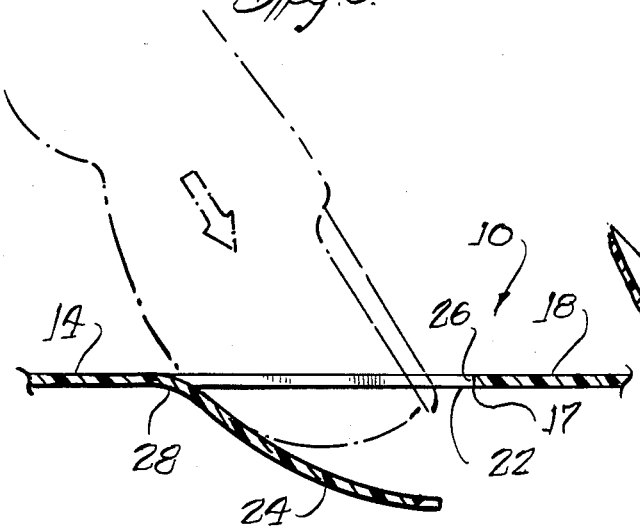
FIG. 3 is an enlarged partial cross-sectional view of the carrier device of FIG. 2 taken along lines 3—3 of FIG. 2 and showing a user applying pressure to the tab forcing the tab in a downward direction.

As shown in FIG. 3, when it is desired to pick up the package a user first applies pressure to tab 24, by inserting a finger in the finger hole 22, so that the detachable means 26 tears and one side of the tab 24 is disengaged from the carrier device 10 and forced in a downward direction. Thus, the user can easily use the finger hole 22.

Figure 4:
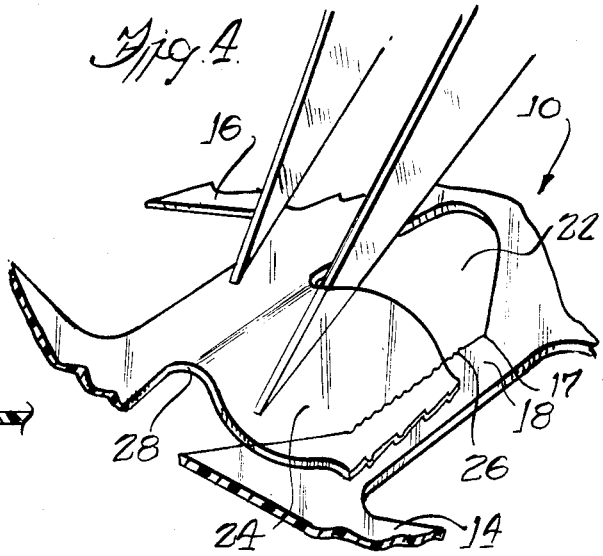
FIG. 4 is a fragmentary perspective view showing the carrier device of FIG. 1 and showing the user disengaging the proof of purchase tab from the carrier device.
Figure 5:
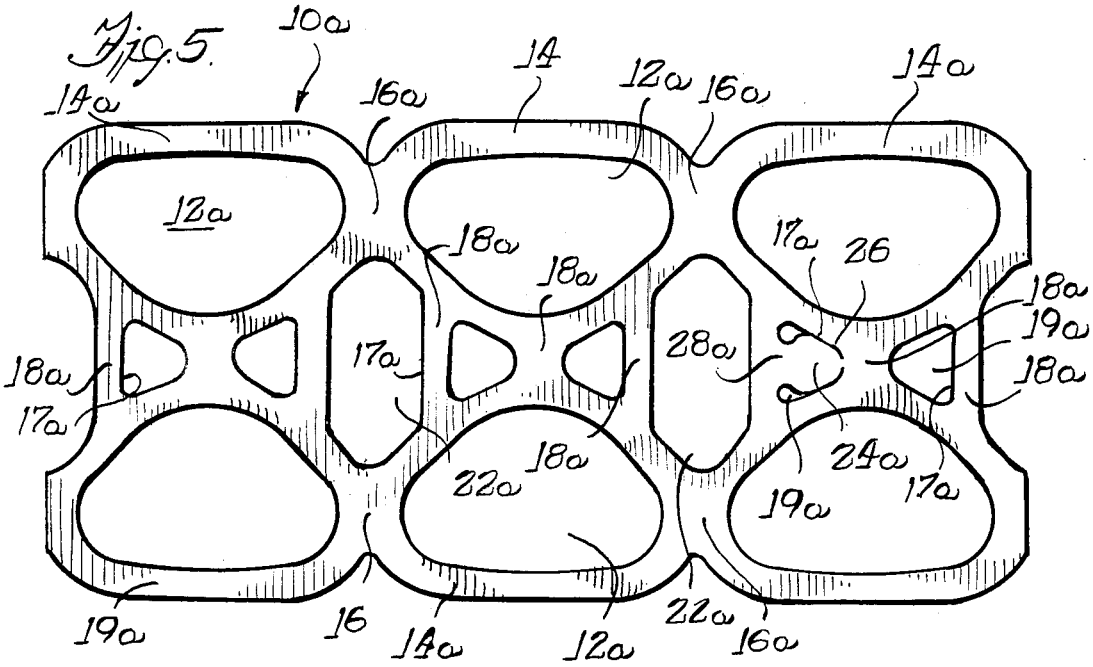
FIG. 5 is a top plan view of an alternative embodiment of this invention.

As shown in FIG. 4, the tab 24 is still securely connected to the carrier device 10 at hinge line 28. Hinge line 28 is not perforated or slit and therefore cannot easily be detached from the carrier device 10. When the containers 20 are removed, the purchaser can remove the proof of purchase tab 24 by cutting along hinge line 28 with scissors 29 or other cutting tools Turning now to FIG. 5 there is shown carrier device 10*a*. Carrier device 10*a* is an alternative form of carrier device 10 and includes elements corresponding to those described above as indicated by the application of the same reference numerals with the suffix a added thereto. However, as shown in FIG. 5, tab 24*a* transverses at least one space means 19*a* rather than a finger hole. The tab 24*a* is secured to a marginal portion 17*a* of one side of the space means 19*a* by detachable means 26*a* and is frangibly connected to a marginal portion 17*a* of an opposite side of space means 19*a* by hinge means or non-detachable means 28*a*.

As the user applies pressure to tab 24*a*, the frangible means 26*a* tears and one side of tab 24*a* is detached from carrier device 10*a*. Tab 24*a* is still securely attached to the carrier device 10 by hinge means 28*a*. The user can then detach the tab 24*a* from the carrier device 10*a* by cutting along hinge line 28*a*.

Figure 6:
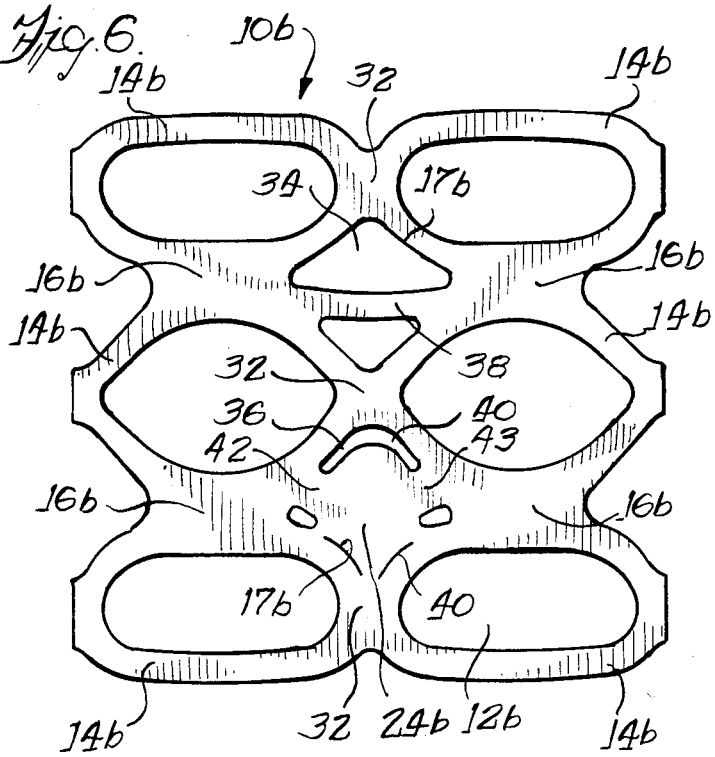
FIG. 6 is a top plan view of an alternative embodiment of this invention.

Turning now to FIG. 6, there is shown a carrier device 10*b*. Carrier device 10*b* is another alternative form of the invention in which elements similar to those described above are designated by the same reference numerals with the suffix b added. As shown in FIG. 6 adjacent pairs of apertures 12*b* in each row and bands 14*b* are integrally connected by webs 16*b*. Adjacent pairs of apertures 12*b* in each rank and bands 14*b* are integrally connected by single web means 32. The adjacent single web means 32 define first and second finger holes or enlarged space means 34 and 36. Finger hole 34 includes a tranverse bar 38 which bisects the finger hole 34. A tab 24*b* transverses finger hole 36. Tab 24*b* is frangibly connected to portions of the margin 17*b* of one side of hole 36 by detachable means 40 comprising a perforated line or junction area. Tab 24*b* is also connected to portions of the margin 17*b* of an opposite side of hole 36 by non-detachable means or junction lines 42 and 43. As before, as a user applies pressure to tab 24*b* the detachable means tears or breaks detaching one side of tab 24*b* from the carrier device 10*b*. Junction lines 42 and 43 can then be cut with a scissors or the like to completely separate the tab 24*b* from the carrier device.

It should be noted that another feature of this invention is that the tabs 24, 24*a* or 24*b* are not free to move or flap relative to the plane of the carrier devices 10, 10*a* and 10*b* during initial production of the carrier device and application to the cans or other containers. This feature prevents the tabs 24, 24*a*, 24*b* from interfering with the production and assembly process.

In assembly, the carrier devices 10, 10*a* and 10*b* are stretched over containers 20 by suitable devices (not shown) which have been placed in a close array defined by ranks and rows. Since the tabs 24, 24*a* or 24*b* are connected to both sides of the spaced means 22 or 34 the tabs 24, 24*a* or 24*b* are not free to move relative to the plane of the carrier devices 10, 10*a* and 10*b*. This will permit the carrier devices 10, 10*a* and 10*b* to be easily handled and wound in assembly.

While particular embodiments of the invention have been shown and described it will be obvious to those skilled in the art that changes and modifications of the present invention in its various aspects, may be made without departing from the invention in its broader aspects. As such, the scope of the invention should not be limited by the particular embodiments and specific construction described herein, but should be defined by the appended claims and equivalents thereof.

The invention is claimed as follows:

1. A carrier device formed from a resilient elastic deformable sheet of plastic material for unitizing a plurality of containers, said carrier device comprising a tab, and a plurality of aperatures arranged in ranks and rows defined by annular bands, adjacent pairs of apertures in a row being integrally connected by band connection means and adjacent pairs of apertures in a rank being integrally connected by additional band connection means, said additional band connection means presenting margins defining a space, said tab being disposed transversing said space between a first of said additional band connection means and a second of said additional band connection means, said tab being connected to a first marginal portion of one side of said space by a non-detachable juncture section and being frangibly connected to a second marginal portion of another side of said space by a detachable juncture section, whereby a user can apply pressure to said tab thereby tearing the detachable juncture section and disengaging the tab remaining secured to said first marginal portion of said space by said non-detachable juncture section.

2. A carrier device of claim 1 wherein said detachable juncture section includes a weakened line and said non-detachable juncture section permits the tab to be folded relative to the remainder of the carrier device.

3. A carrier device of claim 1 wherein the first and second additional band connection means cooperate to connect pairs of apertures in the same rank.

4. A carrier device of claim 1 wherein the first and second additional band connection means each respectively connect apertures in different but adjacent ranks.

* * * * *